US010359164B2

(12) United States Patent
Sozzi et al.

(10) Patent No.: US 10,359,164 B2
(45) Date of Patent: Jul. 23, 2019

(54) MODULAR LIGHTING APPARATUS

(71) Applicant: SOZZI ARREDAMENTI S.R.L., Lecco (IT)

(72) Inventors: Paolo Sozzi, Valmadrera (IT); Fausto Pozzi, Merate (IT)

(73) Assignee: SOZZI ARREDAMENTI S.R.L., Lecco (IT)

( * ) Notice: Subject to any disclaimer, the term of this patent is extended or adjusted under 35 U.S.C. 154(b) by 0 days.

(21) Appl. No.: 15/779,344

(22) PCT Filed: Dec. 12, 2016

(86) PCT No.: PCT/IB2016/057543
§ 371 (c)(1),
(2) Date: May 25, 2018

(87) PCT Pub. No.: WO2017/109636
PCT Pub. Date: Jun. 29, 2017

(65) Prior Publication Data

US 2018/0320846 A1 Nov. 8, 2018

(30) Foreign Application Priority Data

Dec. 22, 2015 (IT) ..... 102015000086249

(51) Int. Cl.
*F21V 21/00* (2006.01)
*F21S 8/06* (2006.01)
(Continued)

(52) U.S. Cl.
CPC ..... *F21S 8/061* (2013.01); *F21S 2/005* (2013.01); *F21V 19/0055* (2013.01);
(Continued)

(58) Field of Classification Search
CPC .. F21S 2/005; F21Y 2107/20; F21Y 2107/40; F21Y 2107/00
(Continued)

(56) References Cited

U.S. PATENT DOCUMENTS 6,585,395 B2 * 7/2003 Luk ..... F21V 14/02 362/249.02
6,851,831 B2 * 2/2005 Karlicek, Jr. ..... H01R 29/00 362/227
(Continued)

FOREIGN PATENT DOCUMENTS

WO WO 2014/127450 A1 8/2014

OTHER PUBLICATIONS

International Search Report for PCT/IB2016/057543 (PCT/ISA/210) dated Mar. 16, 2017.
(Continued)

*Primary Examiner* — Laura K Tso
(74) *Attorney, Agent, or Firm* — Birch, Stewart, Kolsch & Birch, LLP

(57) ABSTRACT

A modular lighting apparatus includes at least one supporting element which is electrically powered and one or more plate-shaped elements with a substantially triangular shape. On each plate-shaped element there are one or more lighting elements of the LED type. The three tips or ends of each triangular plate-shaped element are cut away, forming a rectilinear end portion which can be assembled with a respective supporting element. Each supporting element is equipped with a plurality of seats profiled for receiving respective rectilinear end portions of a plate-shaped element. Each seat is provided with an electrical connector and each plate-shaped element is in turn provided, at each rectilinear end portion, with at least one contact element designed to interface with the electrical connector of each supporting
(Continued)

element. Each plate-shaped element is provided with at least one attachment opening, positioned at a respective rectilinear end portion, while on each seat of a respective supporting element there is at least one hole, designed to act in conjunction with a corresponding attachment opening to make each plate-shaped element integral with the supporting element with the aid of a fixing mechanism, so that the plate-shaped elements can be positioned according to an icosahedron geometrical shape in a complete or partial form.

20 Claims, 7 Drawing Sheets

(51) Int. Cl.

| | |
|---|---|
| ***F21V 19/00*** | (2006.01) |
| ***F21S 2/00*** | (2016.01) |
| *F21Y 115/10* | (2016.01) |
| *F21Y 107/00* | (2016.01) |
| *F21Y 107/20* | (2016.01) |
| *F21Y 107/40* | (2016.01) |

(52) U.S. Cl.
CPC ..... *F21Y 2107/00* (2016.08); *F21Y 2107/20* (2016.08); *F21Y 2107/40* (2016.08); *F21Y 2115/10* (2016.08)

(58) Field of Classification Search
USPC ..... 362/227, 249.02, 249.06, 249.14, 249.16
See application file for complete search history.

(56) References Cited

U.S. PATENT DOCUMENTS

| | | | | |
|---|---|---|---|---|
| 6,923,557 | B2 * | 8/2005 | Jahn | F21S 2/005 362/238 |
| 9,447,928 | B2 * | 9/2016 | Kim | H05B 33/0824 |
| 9,717,119 | B2 * | 7/2017 | Rodinger | H05B 33/0806 |
| 10,030,820 | B2 * | 7/2018 | Rodinger | F21K 9/23 |
| 10,057,451 | B2 * | 8/2018 | Kim | G03B 15/14 |
| 2005/0116667 | A1 | 6/2005 | Mueller et al. | |
| 2009/0086478 | A1 | 4/2009 | Sanroma et al. | |
| 2009/0268464 | A1 | 10/2009 | Zheng | |
| 2010/0264800 | A1 | 10/2010 | Liu et al. | |
| 2011/0134641 | A1 * | 6/2011 | Chen | F21S 2/005 362/249.06 |
| 2014/0218926 | A1 * | 8/2014 | Jackson | F21S 4/10 362/249.16 |
| 2015/0233571 | A1 | 8/2015 | Inan et al. | |

OTHER PUBLICATIONS

Written Opinion of the International Searching Authority for PCT/IB2016/057543 (PCT/ISA/237) dated Mar. 16, 2017.

* cited by examiner

MODULAR LIGHTING APPARATUS

The present invention relates to a modular lighting apparatus.

Various types of lighting apparatuses are known in the prior art. These lighting apparatuses generally consist of one or more electrical lighting elements, at least partially enclosed by a profiled body made of a material transparent to light. It is not therefore possible in these lighting apparatuses to modify the shape of the transparent body, nor is it possible to modify the colour of the transparent body.

For example, US 2015/0233571 A1 discloses a LED lighting system comprising a monolithic lighting body equipped with printed circuit boards (PCB). Each printed circuit is substantially triangular in shape and supports a plurality of lighting elements in the form of light emitting diodes (LED). However, since the lighting body is monolithic, it is not possible to modify the shape of the lighting body, nor is it possible modify the colour.

US 2010/0264800 A1 and US 2009/0268464 A1 also disclose respective embodiments of monolithic type LED lamps, or, in any case, consisting of components assembled together in an irreversible and non-modular manner. It should be noted that a conventional lamp, for example of the incandescent type, typically has a wide spatial luminous distribution, very close to an angle of 360°, whilst a LED lighting element is generally a source of directional lighting. In fact, each LED emits lights on a single face of the printed circuit or chip on which the LED is applied. The LED lighting elements can therefore be easily adapted to "technical" lighting apparatuses, whilst they are not very versatile when used on "furnishing" lighting apparatuses, where the apparatus itself is the first object which must be illuminated and enhanced by the adequacy and quality of the light emitted.

In order to obviate the drawbacks of the prior art, modular lighting apparatuses have been provided, such as, for example, the one disclosed in US 2005/0116667 A1. However, US 2005/0116667 A1 discloses a modular LED lighting system specifically designed for a false ceiling. In other words, the lighting system disclosed in US 2005/0116667 A1 does not allow the external geometrical shape of the light source to be freely modified.

WO 2014/127450 A1 discloses a LED lighting apparatus consisting of a plurality of lighting elements. Each lighting element consists in turn of a respective printed circuit board (PCB) of various polygonal shapes, including also the triangular shape. However, also in this case, the lighting apparatus disclosed in WO 2014/127450 A1 is designed to always have a closed bulb shape, thus considerably limiting the modularity possibilities. Lastly, US 2009/0086478 A1 discloses a lighting system which is again designed to adopt a closed polyhedral shape, or a flat shape, wherein the single lighting elements are positioned alongside each other as occurs, for example, for the panels of a false ceiling.

The purpose of the present invention is, therefore, to provide a modular lighting apparatus which is able to overcome the above-mentioned drawbacks of the prior art in an extremely simple, economical and particularly functional manner.

In detail, a purpose of the present invention is to provide a lighting apparatus which is freely variable with regard to its external shape.

Another purpose of the present invention is to provide a lighting apparatus which allows the colour of the single lighting elements which make up the lighting apparatus to be freely modified.

These and other purposes according to the present invention are achieved by providing a modular lighting apparatus as described in claim 1.

Further features of the invention are disclosed in the dependent claims, which form an integral part of the description.

The characteristics and advantages of a modular lighting apparatus according to the present invention will become better apparent from the following description of an embodiment thereof given by way of non-limiting example, with reference to the accompanying schematic drawings in which.

Figure 1:
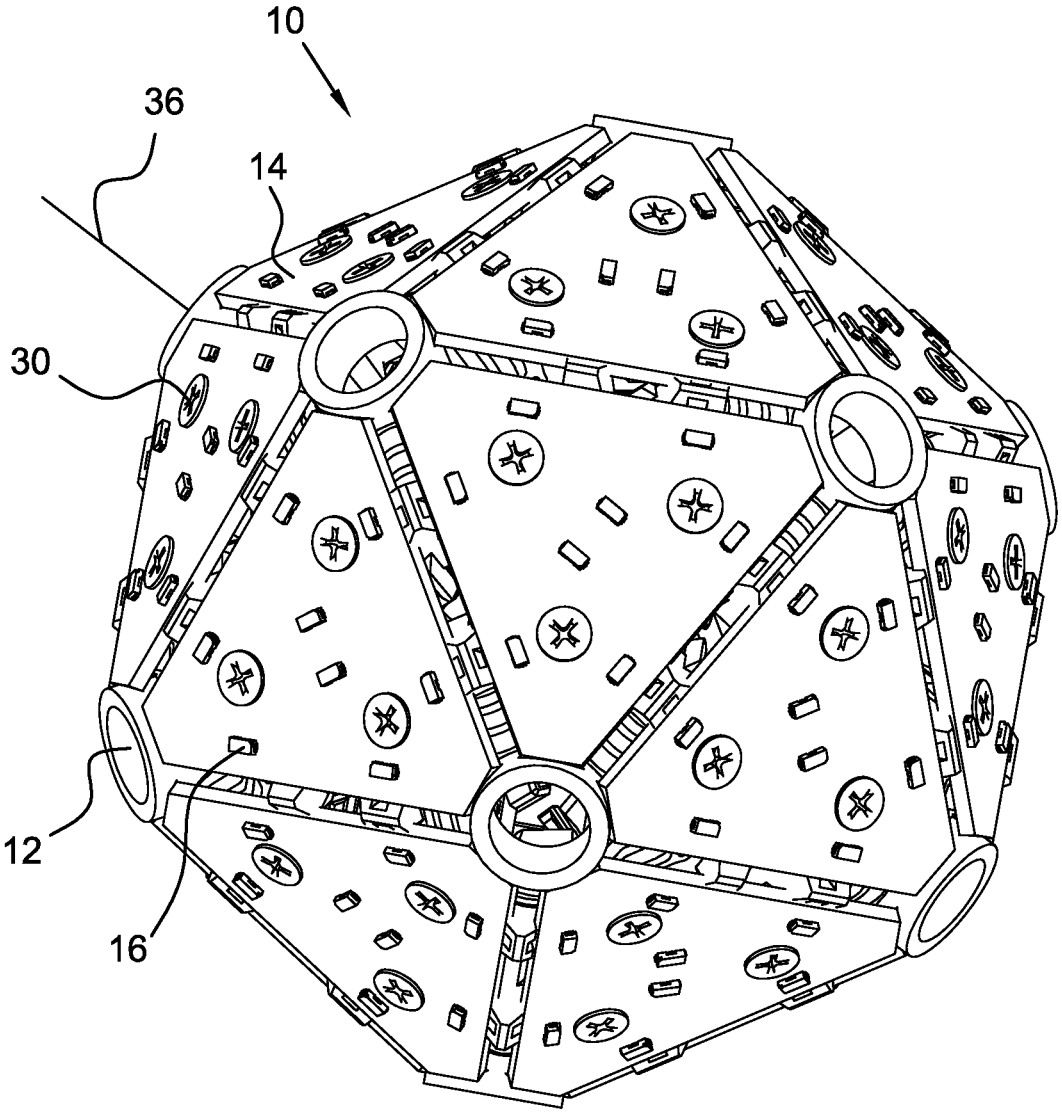
FIG. 1 shows a first embodiment of a modular lighting apparatus according to the present invention, comprising a plurality of supporting elements operatively connected to a corresponding plurality of lighting elements in the form of a triangle.

With reference to the figures, some preferred embodiments of the modular lighting apparatus according to the present invention are illustrated by way of example, which modular lighting apparatus is identified in its entirety by reference numeral 10. The lighting apparatus 10 comprises at least one supporting element which is electrically powered, that is to say, equipped with at least one connector 40 for connection to the electricity supply, as well as one or more plate-shaped elements 14 with a substantially triangular shape.

One or more lighting elements 16, conveniently of the LED type, are arranged on each plate-shaped element 14. In detail, each plate-shaped element 14, triangular in shape, consists of a LED module which can house, preferably, eight lighting elements 16 in the embodiment of FIG. 1 ("small" version of the lighting apparatus 10) and twelve lighting elements 16 in the embodiment of FIG. 2 ("large" version of the lighting apparatus 10). It will be understood that these embodiments are provided merely by way of example and that each triangular plate-shaped element 14 can have any dimension and quantity of lighting elements 16.

Figure 5:
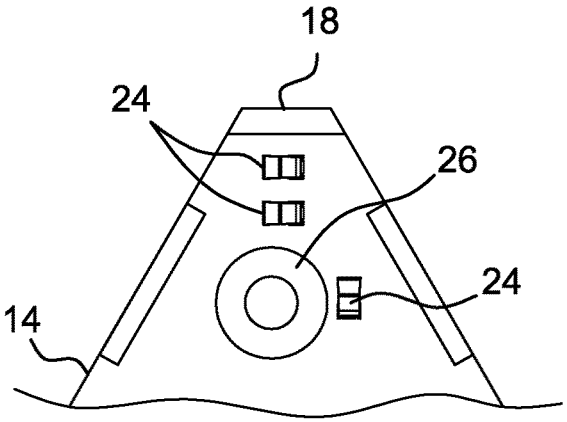
FIG. 5 is a plan view of a portion of a single lighting element of the modular lighting apparatus according to the present invention.
Figure 6:
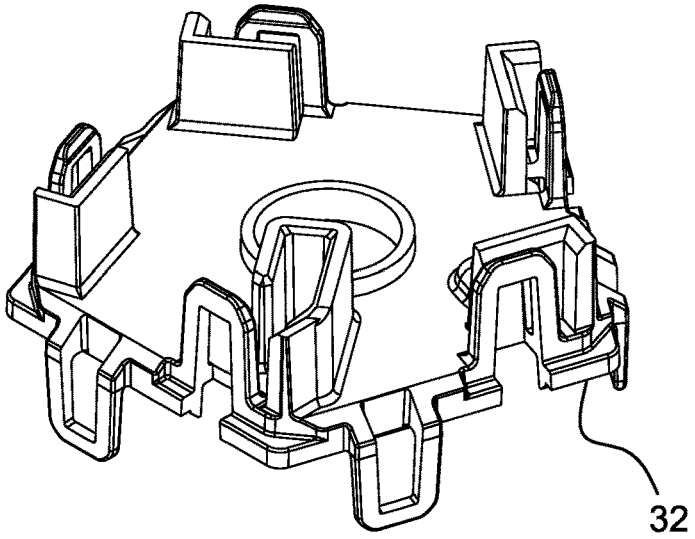
FIGS. 6 and 7 are perspective views of two further components of the modular lighting apparatus according to the present invention.
Figure 7:
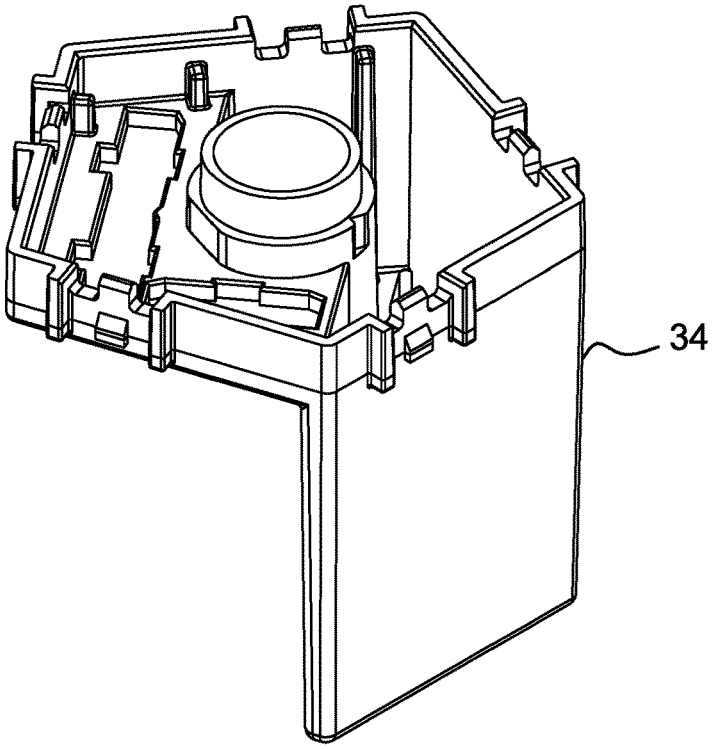

As shown for example in FIG. 5, the three tips or ends of each triangular plate-shaped element 14 are cut away, forming a rectilinear end portion 18. Each rectilinear end portion 18 of each plate-shaped element 14 can then be assembled with a respective supporting element 12.

In detail, each supporting element 12 is provided with a plurality of seats 20, preferably five in number. Each seat 20 is shaped for receiving one of the rectilinear end portions 18 of a respective plate-shaped element 14. Regardless of the fact that the supporting element 12 is powered electrically or not, each seat 20 is also provided with electrical connection means 22, such as, for example, a plurality of conductive tracks deposited galvanically.

Figure 4:
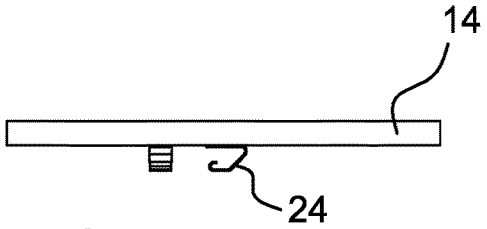
FIG. 4 is a side elevation view of a portion of a single lighting element of the modular lighting apparatus according to the present invention.

Each plate-shaped element 14 is in turn provided, at each rectilinear end portion 18, with at least one contact element 24 (FIG. 4) designed for interfacing with the electrical connection means 22 of each supporting element 12. Each contact element 24 is preferably made in the form of an elastically deformable metallic plate.

As shown very schematically in FIG. 5, each plate-shaped element 14 is provided with at least one attachment opening 26, positioned at a respective rectilinear end portion 18. Each seat 20 of a respective supporting element 12 is provided with at least one hole 28, designed to act in conjunction with a corresponding attachment opening 26 to make each plate-shaped element 14 integral with the supporting element 12 with the aid of fixing means 30. The fixing means 30 can conveniently consist of screws or other mechanical means designed for rendering each plate-shaped lighting element 16 integral with the supporting element 12.

In the embodiment of FIGS. 8A to 8E each supporting element 12 is provided with seats 20 having a straight base, from which ribs branch off in an inclined fashion according to the adjacent sides of a plate-shaped element 14 having a triangular shape. Consequently, in the corresponding seat 20 of a corresponding supporting element 12, made in the form of a blind hole, a respective rectilinear end portion of a triangular plate-shaped element 14 can be introduced.

Figure 2:
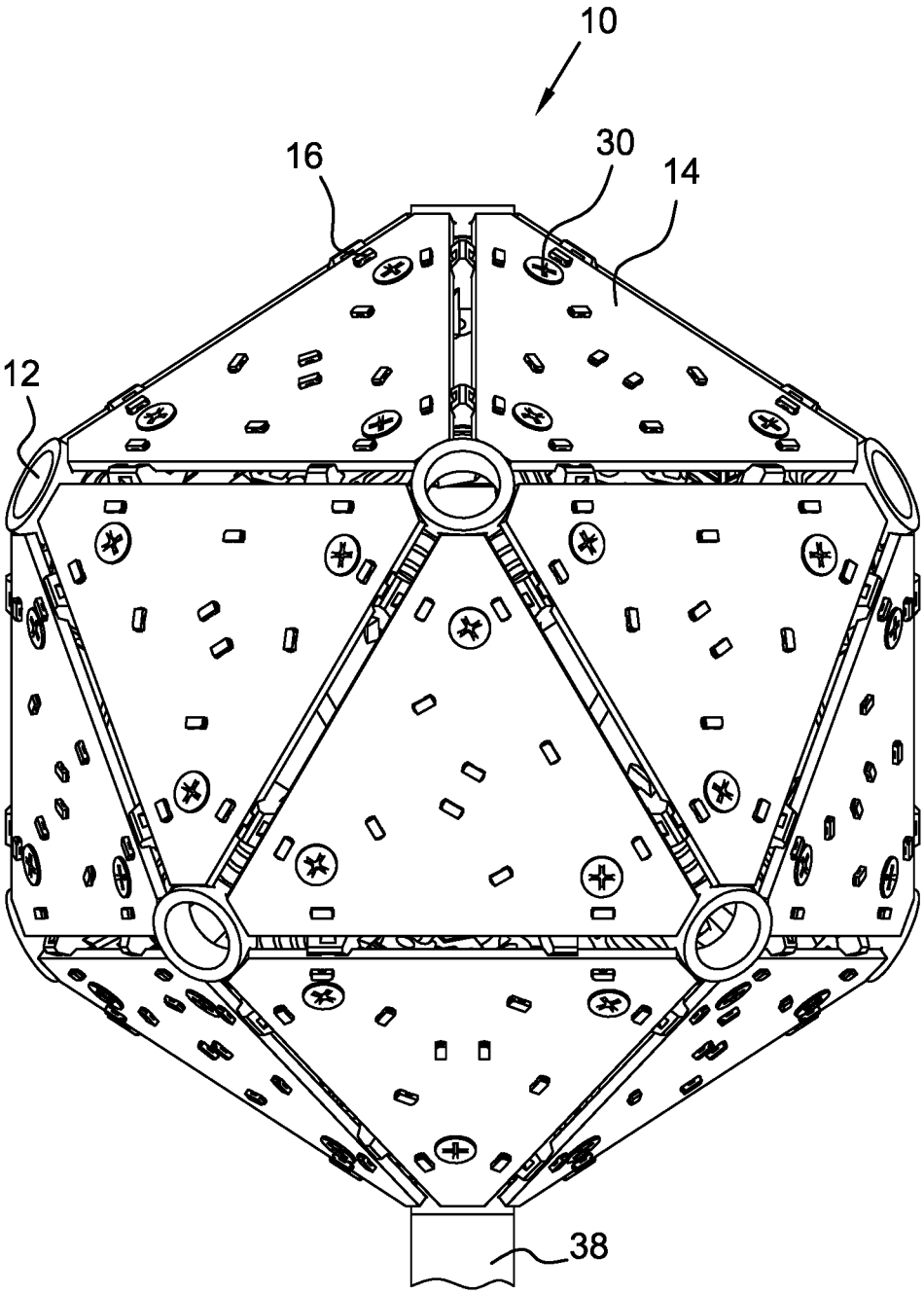
FIG. 2 shows another embodiment of a modular lighting apparatus according to the present invention, which differs from the first embodiment of FIG. 1 substantially in terms of the dimensions of the lighting elements in the form of a triangle.
Figure 3:
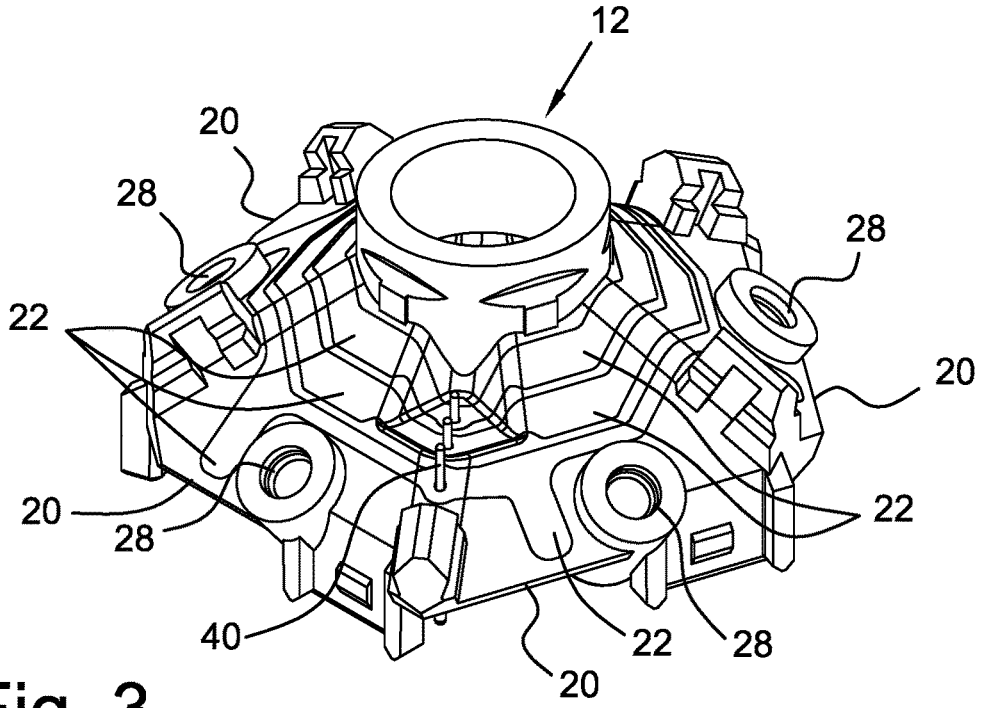
FIG. 3 is a perspective view of a single supporting element of the modular lighting apparatus according to the present invention.

In the embodiment of FIGS. 1 and 2, each supporting element 12 is instead provided with seats 20 which are open at the top, in which the mechanical and electrical connection of each triangular plate-shaped element 14 occurs simply by means of the tightening of the screws 30 and the consequent electrical contact between the contact elements 24 and the electrical connection means 22. This configuration has the advantage of making it extremely easy and fast to assemble each plate-shaped element 14 on the respective supporting element 12, as well as any removal of one or more plate-shaped elements 14, for replacing, for example, in the case of a fault or for modifying the layout of the lighting apparatus 10, as will be described more in detail hereinafter.

The lighting apparatus 10 may be conveniently provided with one or more dimmers (not shown) or other electronic devices intended to control the luminous emission of each lighting element 16. For this purpose, each supporting element 12 can be operatively and electrically connected to one or more components 32 and 34 designed for housing the above-mentioned electronic devices.

Each of these electronic devices can be operatively and electrically connected to a respective supporting element 12 by means of a snap-on coupling, that is to say, without screws. Each one of these electronic devices is able, by means of a special command (not shown) mounted on the lighting apparatus 10 or by means of a Wi-Fi command, to switch ON, switch OFF and regulate the luminous intensity of the lighting apparatus 10.

FIG. 1 shows that the lighting apparatus 10, consisting of single plate-shaped elements 14 to make a body in the shape of an icosahedron, either complete or partial, is designed to be suspended from a celling by means of a cable 36, which may also be a line for supplying electric current to the supporting element 12 equipped with a connector 40. It may be seen in FIG. 2 that the lighting apparatus 10 can also be supported by means of one or more rods 38, designed for mounting on a wall or resting on any flat surface.

The assembly of the lighting apparatus 10, both for the "large" version of FIG. 2 (with 70 mm LED modules) and for the "small" version of FIG. 1 (with 50 mm LED modules), is done starting from a supporting element 12 which is electrically powered, that is to say, equipped with a connector 40. According to the configuration which is to be obtained, as many plate-shaped elements 14 will be positioned as are required by the configuration.

Each plate-shaped element 14 is kept in position by at least one respective screw 30 which is screwed in a corresponding attachment opening 26. The fixing method is the same also for all the other plate-shaped elements 14. If another supporting element 12 is requested, the latter may also not be a supporting element 12 which is electrically powered, but could be a simple supporting element 12 without the connector 40 for connecting to the electricity supply.

Figure 8A:
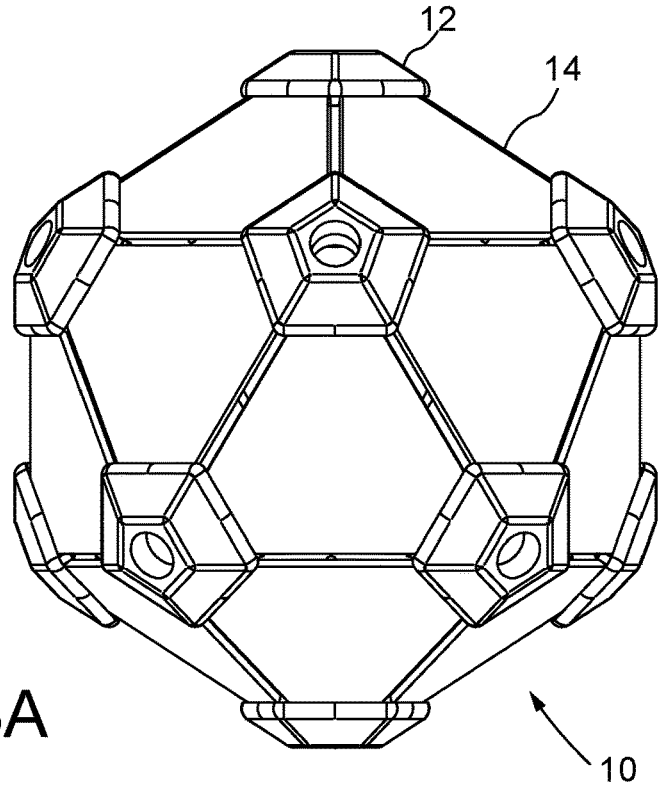
FIGS. 8A to 8E show, by way of example, the various possibilities of making up, in different ways, a specific embodiment of the modular lighting apparatus according to the present invention.

FIGS. 8A to 8E show the multitude of compositions and uses which can derive from the use of a variable number of plate-shaped elements 14, obtaining variable shapes which can fall within the geometry of a icosahedron. For example, FIG. 8A shows the three-dimensional base shape of the lighting apparatus 10, that is to say, the icosahedron. The icosahedron is an isotropic shape, that is to say, independent of the direction. This remedies the problem of the directionality in the use of lighting elements 16 in the form of LEDs. In the configuration shown in FIG. 8A the twelve vertices of the icosahedron consist of as many supporting elements 12, which are able to transmit voltage and current to the twenty plate-shaped elements 14 by means of the electrical connection means 22, as well as ensuring a mechanical connection between the various components making up the icosahedron.

Since the plate-shaped elements 14 are electrically independent from each other, it is not necessary to house all twenty plate-shaped elements 14 in order to operate the lighting apparatus 10. Each plate-shaped element 14 is in fact configured to regulate independently the current of the lighting elements 16 (LED) housed on it. The geometrical shape of the icosahedron may therefore be reproduced in its entirety or partially, that is to say, completing only a part of the faces of the geometrical solid, depending on the lighting need of each lighting apparatus 10.

Figure 8B:
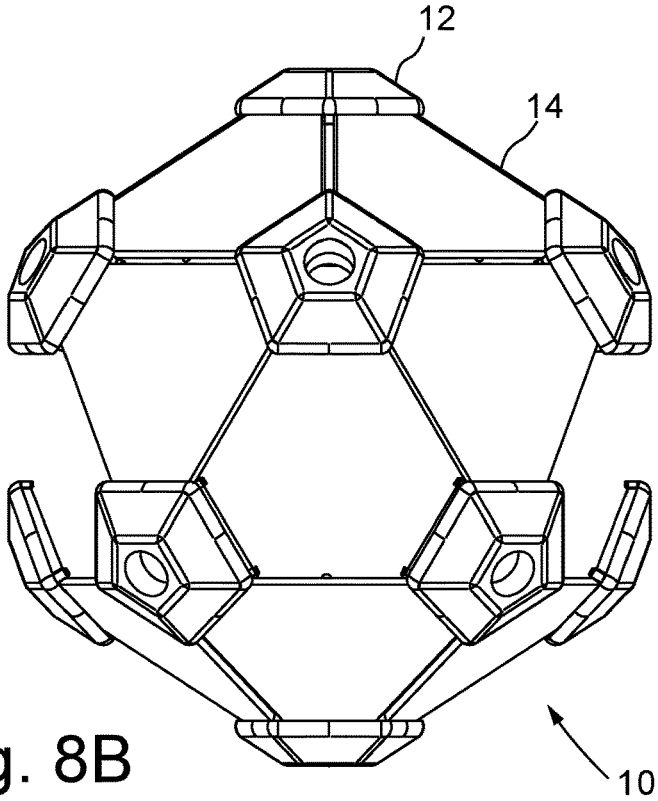
Figure 8C:
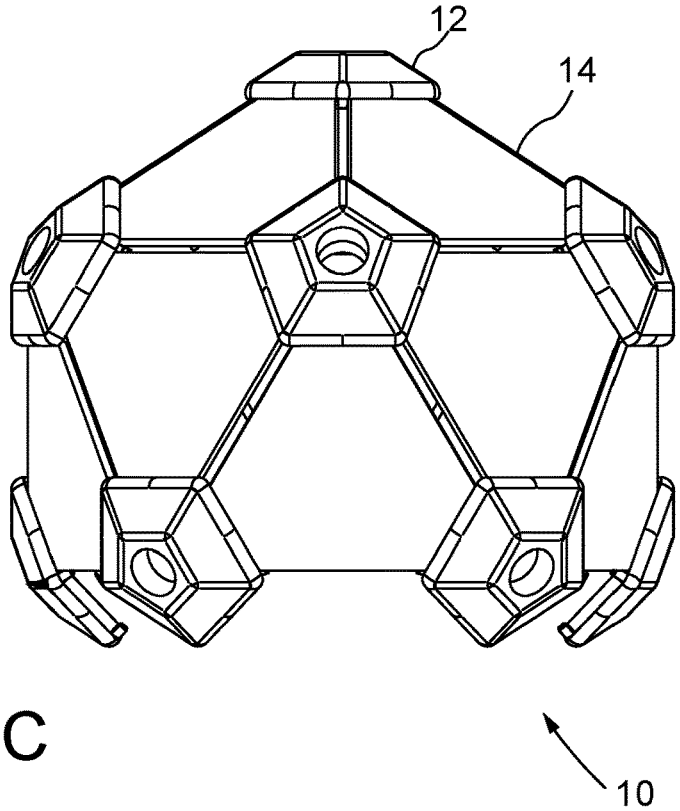
Figure 8D:
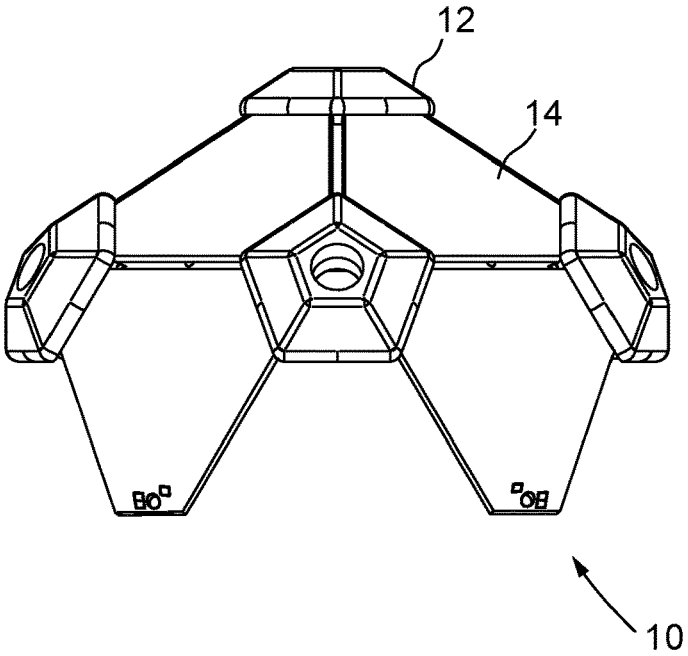
Figure 8E:
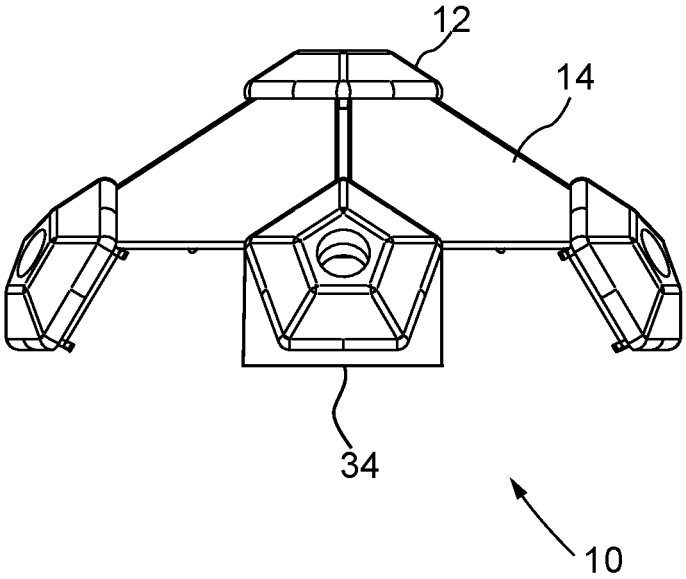

For example, FIG. 8B shows a lighting apparatus 10 with a reduced lateral luminosity, that is to say, without at least part of the plate-shaped elements 14 provided on its lateral surfaces. FIG. 8C shows a lighting apparatus 10 with a reduced lower luminosity, that is to say, without the plate-shaped elements 14 provided on its lower portion. FIG. 8D shows a lighting apparatus 10 with reduced luminosity both to the sides and below, whilst FIG. 8E shows a lighting apparatus 10 designed only for upper lighting.

It can therefore be seen that the modular lighting apparatus according to the present invention achieves the above-mentioned purposes.

The modular lighting apparatus according to the present invention thus conceived is susceptible of numerous modifications and variations, all within the scope of the same inventive concept. Moreover, all the details may be replaced by technically equivalent elements. In practice, all the materials used, as well as the shapes and dimensions may be any, depending on technical requirements.

The scope of protection of the present invention is therefore defined by the appended claims.

The invention claimed is:

1. A modular lighting apparatus, comprising:

at least one supporting element which is electrically powered;

one or more plate-shaped elements substantially triangular in shape; and one or more lighting elements positioned on each plate-shaped element, wherein the three tips or ends of each triangular plate-shaped element are cut away, forming a rectilinear end portion, wherein each rectilinear end portion of each plate-shaped element can be assembled with a respective supporting element, wherein each supporting element is equipped with a plurality of seats shaped for receiving respective rectilinear end portions of a plate-shaped element, wherein each seat is provided with an electrical connector, wherein each plate-shaped element is provided, at each rectilinear end portion, with at least one contact element designed to interface with the electrical connector of each supporting element, wherein each plate-shaped element is provided with at least one attachment opening, arranged at a respective rectilinear end portion, and wherein on each seat of a respective supporting element there is at least one hole, designed to act in conjunction with a corresponding attachment opening to make each plate-shaped element integral with the supporting element, with the aid of fixing means, by which the plate-shaped elements can be positioned according to an icosahedron geometrical shape in a complete or partial form.

2. The modular lighting apparatus according to claim 1, wherein each supporting element is provided with seats made in the form of a blind hole and having a straight base, from which ribs branch off in an inclined fashion according to the adjacent sides of a plate-shaped element, so that a respective rectilinear end portion of a triangular plate-shaped element can be introduced in the corresponding seat of a corresponding supporting element.

3. The modular lighting apparatus according to claim 1, wherein each supporting element is provided with seats which are open at the top thereof, in which the mechanical and electrical connection of each triangular plate-shaped element occurs by action of the fixing means and the consequent electrical contact between the contact elements and the electrical connector.

4. The modular lighting apparatus according to claim 1, wherein the electrical connector consist of a plurality of conductive tracks deposited galvanically.

5. The modular lighting apparatus according to claim 1, wherein each contact element is made in the form of an elastically deformable metallic plate.

6. The modular lighting apparatus according to claim 1, wherein the fixing means consist of screws designed for rendering each plate-shaped lighting element integral with the supporting element.

7. The modular lighting apparatus according to claim 1, further comprising one or more electronic devices designed to control the luminous emission of each lighting element, wherein each supporting element is operatively and electrically connected to one or more components designed for housing said one or more electronic devices.

8. The modular lighting apparatus according to claim 7, wherein each of the one or more electronic devices is operatively and electrically connected to a respective supporting element by a snap-on coupling and is equipped with a Wi-Fi command for switching ON, switching OFF and regulating the luminous intensity of the lighting apparatus.

9. The modular lighting apparatus according to claim 1, wherein the lighting apparatus is suspended with the aid of a cable, the cable forming a line for supplying electric current towards each supporting element.

10. The modular lighting apparatus according to claim 1, wherein said lighting apparatus is supported by one or more rods, designed for mounting on a wall or for resting on any flat surface.

11. The modular lighting apparatus according to claim 2, wherein the electrical connector consist of a plurality of conductive tracks deposited galvanically.

12. The modular lighting apparatus according to claim 3, wherein the electrical connector consist of a plurality of conductive tracks deposited galvanically.

13. The modular lighting apparatus according to claim 2, wherein each contact element is made in the form of an elastically deformable metallic plate.

14. The modular lighting apparatus according to claim 3, wherein each contact element is made in the form of an elastically deformable metallic plate.

15. The modular lighting apparatus according to claim 4, wherein each contact element is made in the form of an elastically deformable metallic plate.

16. The modular lighting apparatus according to claim 2, wherein the fixing means consist of screws designed for rendering each plate-shaped lighting element integral with the supporting element.

17. The modular lighting apparatus according to claim 3, wherein the fixing means consist of screws designed for rendering each plate-shaped lighting element integral with the supporting element.

18. The modular lighting apparatus according to claim 4, wherein the fixing means consist of screws designed for rendering each plate-shaped lighting element integral with the supporting element.

19. The modular lighting apparatus according to claim 5, wherein the fixing means consist of screws designed for rendering each plate-shaped lighting element integral with the supporting element.

20. The modular lighting apparatus according to claim 2, further comprising one or more electronic devices designed to control the luminous emission of each lighting element, wherein each supporting element is operatively and electrically connected to one or more components designed for housing said one or more electronic devices.

* * * * *